United States Patent [19]

Maloney

[11] 4,263,765

[45] Apr. 28, 1981

[54] HIGH MASS WALL MODULE FOR ENVIRONMENTALLY DRIVEN HEATING AND COOLING SYSTEM

[75] Inventor: Timothy Maloney, Winchester, Va.

[73] Assignee: One Design Inc., Winchester, Va.

[21] Appl. No.: 942,131

[22] Filed: Sep. 13, 1978

[51] Int. Cl.[3] ..... E04B 1/04; E04C 1/16

[52] U.S. Cl. ..... 52/562; 52/173 R; 52/309.11; 52/309.12; 52/405; 52/410; 52/426; 52/564; 52/571; 52/572

[58] Field of Search ..... 52/309.11, 309.12, 309.17, 52/309.1, 405, 410, 396, 403, 426, 508, 509, 562, 563, 564, 565, 571, 572, 586, 579, 173R

[56] References Cited

U.S. PATENT DOCUMENTS

| | | | |
|---|---|---|---|
| 1,345,156 | 6/1920 | Flynn | 52/426 X |
| 1,556,066 | 10/1925 | Bell | 52/564 |
| 2,033,831 | 3/1936 | Jensen | 52/570 |
| 2,061,486 | 11/1936 | Schuh | 52/565 |
| 2,086,571 | 7/1937 | Novambere | 52/410 |
| 2,172,052 | 9/1939 | Robbins | 52/405 |
| 2,677,664 | 5/1954 | Telkes | 52/173 R |
| 2,684,588 | 7/1954 | Robertson | 52/426 |
| 2,854,841 | 10/1958 | Simmons | 52/564 |
| 3,248,836 | 5/1966 | Stark | 52/508 X |
| 3,295,278 | 1/1967 | Muhm | 52/223 |
| 3,325,198 | 6/1967 | Cruse | 52/426 X |
| 4,003,426 | 1/1977 | Best | 52/173 R |
| 4,098,040 | 7/1978 | Riefler | 52/404 |
| 4,123,881 | 11/1978 | Muse | 52/405 |

FOREIGN PATENT DOCUMENTS

| | | | |
|---|---|---|---|
| 661203 | 4/1962 | Canada | 52/309.1 |
| 713293 | 7/1965 | Canada | 52/562 |
| 924922 | 4/1973 | Canada | 52/426 |
| 1012054 | 7/1957 | Fed. Rep. of Germany | 52/405 |
| 2426762 | 5/1975 | Fed. Rep. of Germany | 52/562 |
| 2362445 | 6/1975 | Fed. Rep. of Germany | 52/586 |
| 2461866 | 7/1976 | Fed. Rep. of Germany | 52/405 |
| 514650 | 3/1921 | France | 52/173 R |
| 1037953 | 5/1953 | France | 52/582 |
| 1485237 | 5/1967 | France | 52/309.1 |
| 357728 | 3/1938 | Italy | 52/564 |
| 567155 | 1/1957 | Italy | 52/309.1 |
| 26078 | of 1912 | United Kingdom | 52/579 |
| 558804 | 1/1944 | United Kingdom | 52/562 |
| 1223751 | 3/1971 | United Kingdom | 52/562 |

*Primary Examiner*—Alfred C. Perham

*Attorney, Agent, or Firm*—Cushman, Darby & Cushman

[57] ABSTRACT

Each module includes a block body and an outer wear surface joined by one or more separator webs. The block body either is massive as constructed, or receives a massive filling, such as concrete, at the job site. Provision is also made for providing a filling of thermal insulation such as foamed synthetic plastic for the module. Modules are stacked and coursed to make walls. Mortar may be used between adjacent modules, and/or the module walls may be facially coated with a substance which securely interconnects the modules. Such walls have a high interior mass, insulated on the exterior and protected exteriorly of the insulation by the wear surface. The high mass tends to assume room temperature and perform as a thermal energy flywheel. Some measures for partial prefabrication of module parts are disclosed.

5 Claims, 24 Drawing Figures

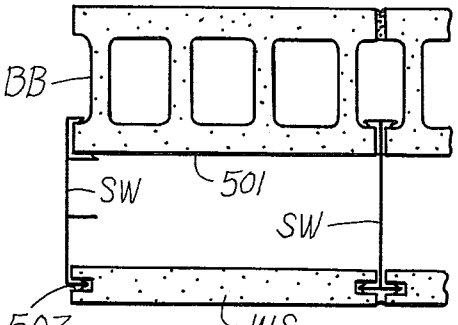
FIG. 10
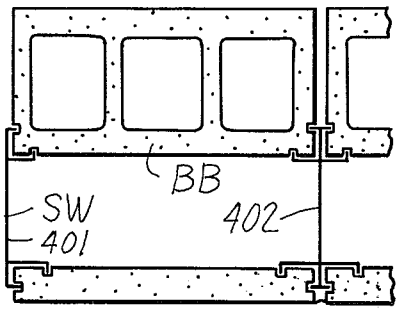
FIG. 9
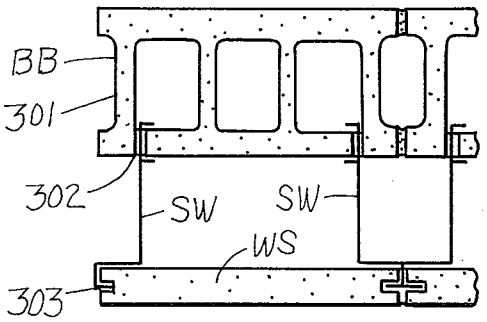
FIG. 8
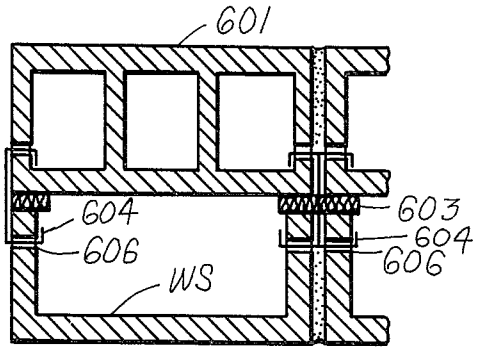
FIG. 11
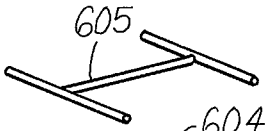
FIG. 12
FIG. 13
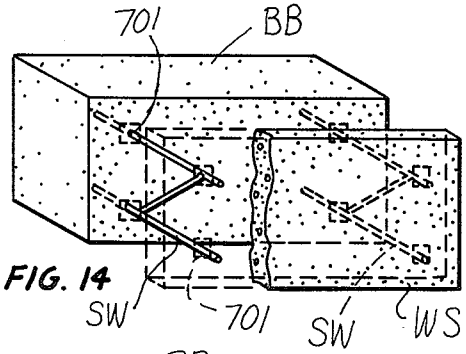
FIG. 14
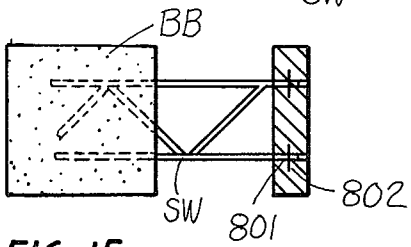
FIG. 15
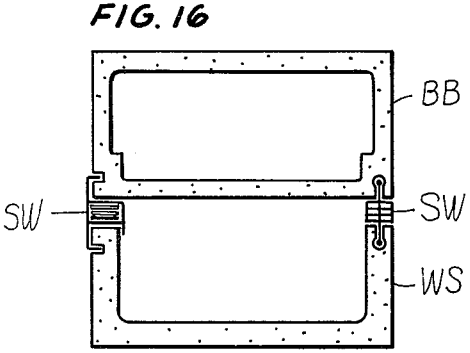
FIG. 16
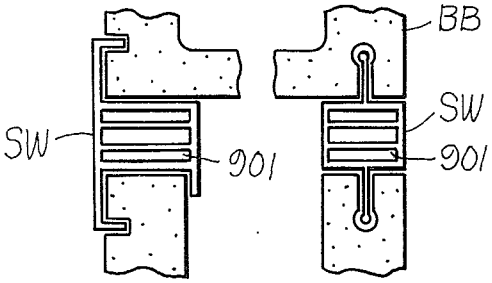
FIG. 17
FIG. 18

HIGH MASS WALL MODULE FOR ENVIRONMENTALLY DRIVEN HEATING AND COOLING SYSTEM

REFERENCE TO RELATED APPLICATIONS

More ways and means for providing largely passive, environmentally driven heating and cooling systems for building structures are described in my copending application Ser. No. 941,735, filed Sept. 12, 1978, entitled Environmentally Driven Heating and Cooling System and in my copending application Ser. No. 942,133, filed Sept. 13, 1978, entitled Thermosiphoning Module for Environmentally Driven Heating and Cooling System.

BACKGROUND OF THE INVENTION

Recently, there have been published a number of books which survey the present state of the art of solar heating and cooling of buildings. Noteworthy are:

*The Solar Home Book, heating, cooling and designing with the sun,* Bruce Anderson with Michael Riordan, Cheshire Books, Hanesville, New Hampshire (1976); and

*Designing and Building a Solar House, Your Place in the Sun,* Donald Watson, Garden Way Publishing, Charlotte, Vermont (1977).

Particularly of interest in the Anderson book are the following topics:

M.I.T. Solar House II (1947), pp. 23, 24; Telkes et al—Dover House (1948), pp. 24, 25; Jonathan Hammond—Winters House (1974), pp. 40–42, 181, Chapter 4—Direct Solar Heating, pp.76–113; Wright House (1974), pp. 108, 109; Odillo House 1962 (1962), p. 129; Zomeworks—Baer House (1971–1972), pp. 129–133, 181; Kalwall Corp. "Sun-Lite" storage wall collectors, pp. 133, 240, 241; Harold Hay/Sky Therm Process and Engineering—Solar Architecture House (1973), pp. 133, 137, Phoenix Test Building (1967), pp. 135–137, Sky Therm North, p. 140; Total Environmental Action—Jackson Freese House, p. 140; Day Chahroudi—Subfloor Heat Storage, p. 142; Small Containers of Water, p. 188, 189; Solar Cooling, p. 197, 198; Bill and Susan Yanda—Solar Sustenance, pp. 233–239; Jonathan Hammond—Hammond House (1975), pp. 239–241.

Particularly of interest in the Watson book are the following topics:

M.I.T. Solar House II (1947), pp. 6, 7; Telkes el at—Dover House (1948), p. 6, 7; Wright House (1974), p. 29; Zomeworks—Baer House (1971–1972), pp. 35, 45; Kalwall Corp. "Sun-Lite" storage wall collectors, p. 38; Harold Hay/Sky Therm Process and Engineering—Solar Architecture House (1973), pp. 31, 38–40, 47–49; Other Window Collector Designs, p. 30; Bill Mingenbach, p. 38; Prof. Shawn Buckley/M.I.T.—Thermic Diode Solar Building Panels, pp. 41, 42; J. D. Balcomb and J. C. Hedstrom—Simulation Analysis of Passive Solar Heated Buildings, Los Alamos Scientific Laboratory p. 48; Selecting a Solar Heating Approach, pp 172–174.

Both books contain extensive bibliographies and appendices of interest.

There are prior U.S. patents showing inclusions of thermal insulation bodies within masonary wall structural units. Examples are:

| Patentee | Patent No. | Issue Date |
|---|---|---|
| Elgenstierna, et al | 3,271,497 | September 6, 1966 |
| Muhm | 3,295,278 | January 3, 1967 |

SUMMARY OF THE INVENTION

Each module includes a block body and an outer wear surface joined by one or more separator webs. The block body either is massive as constructed, or receives a massive filling, such as concrete, at the job site. Provision is also made for providing a filling of thermal insulation such as foamed synthetic plastic for the module. Modules are stacked and coursed to make walls. Mortar may be used between adjacent modules, and/or the module walls may be facially coated with a substance which securely interconnects the modules. Such walls have a high interior mass, insulated on the exterior and protected exteriorly of the insulation by the wear surface. The high mass tends to assume room temperature and perform as a thermal energy flywheel. In the heating season, the thermal energy flywheel absorbs heat from sunlight during the day and/or from being artificially heated during off peak hours when energy is more cheaply available, and releases this stored energy to the room air when the room needs heating. In the cooling season, the flywheel is active if shaded in the day to act as a heat sink for such heat as does enter the building from raising the room air temperature so much. At night in the cooling season, the flywheel is active to tend to lose heat from the room to the night air. Some measures for partial prefabrication of module parts are disclosed.

It is an object of the present invention to provide marketable, economical ways and means for providing building structure wall systems comprising modules of superior weather-protected exterior thermal insulation upon a massive energy storage element.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 8 is a fragmentary top plan view of a wall incorporating examples of a third module embodiment.

FIG. 9 is a fragmentary top plan view of a wall incorporating examples of a fourth module embodiment.

FIG. 10 is a fragmentary top plan view of a wall incorporating examples of a fifth module embodiment.

FIG. 11 is a fragmentary top plan view of a wall incorporating examples of a sixth module embodiment.

FIG. 12 is a larger-scale perspective view of the staple shown at the right in FIG. 11, prior to assembly with the modules; and FIG. 13 is a larger-scale perspective view of the staple shown at the left in FIG. 11, prior to assembly with the modules.

FIG. 14 is a perspective view, with a portion broken away, but outlined in phantom lines, of a seventh module embodiment; and FIG. 15 is a horizontal cross-sectional view, of an eighth module embodiment.

FIG. 16 is a top plan view of a ninth module embodiment.

FIG. 17 is a larger-scale fragmentary top plan view of the circled region at the left in FIG. 16; and FIG. 18 is a larger-scale fragmentary top plan view of the circled region at the right in FIG. 16, showing the two alternative attachments.

DETAILED DISCUSSION OF THE PRESENTLY PREFERRED EMBODIMENTS OF THE INVENTION

In the discussion of the various embodiments, the symbols B.B., W.S. and S.W. are used to denote functionally like elements, even though separate numbers are given to the various modules and parts constituting the several embodiments.

Figure 1:
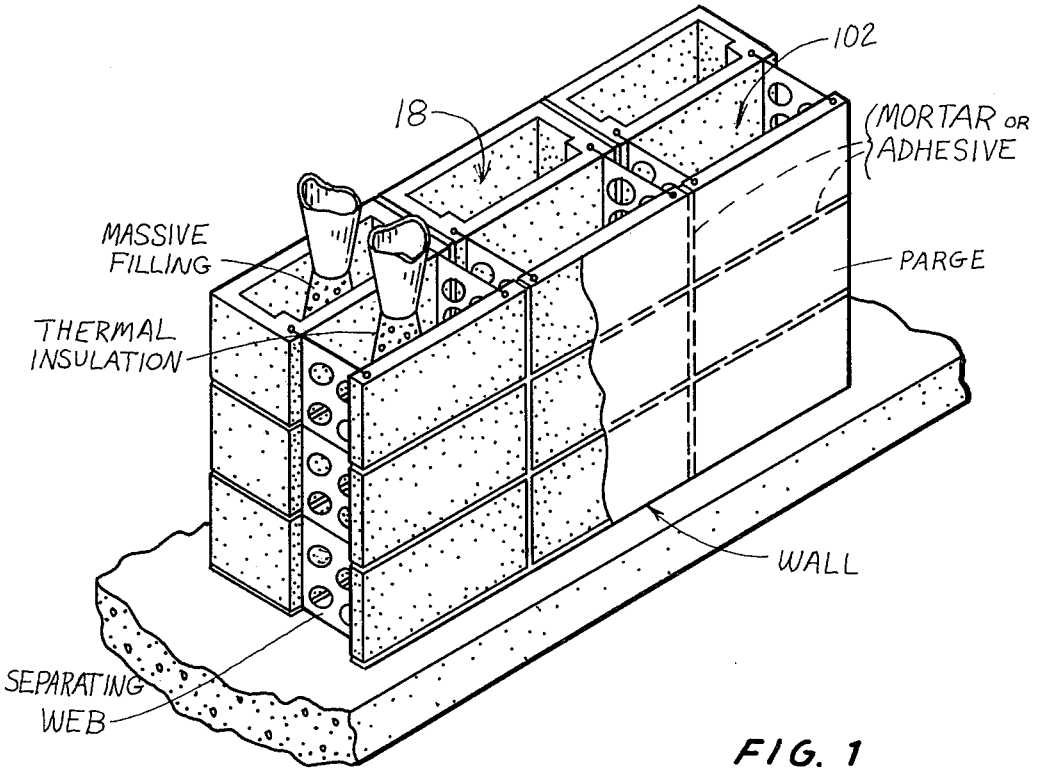
FIG. 1 is a perspective view of a sample portion of a wall of a building structure being fabricated using modules, ways and means provided in accordance with principles of the present invention.
Figure 2:
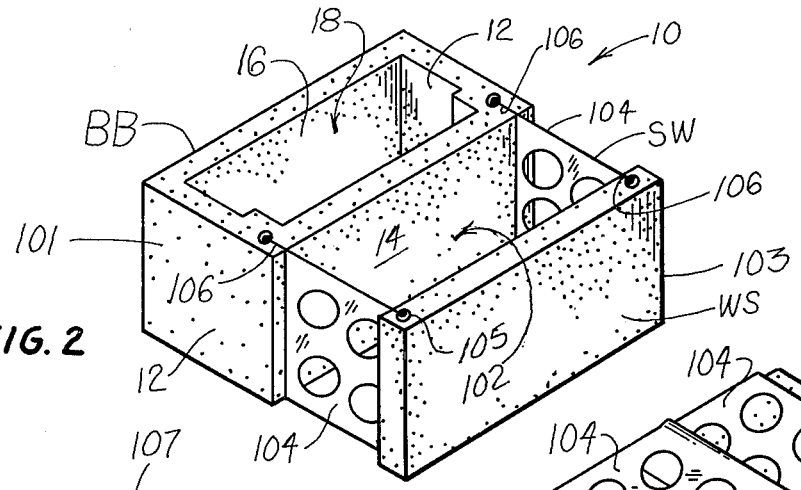
FIG. 2 is a perspective view of a first module embodiment.
Figure 3:
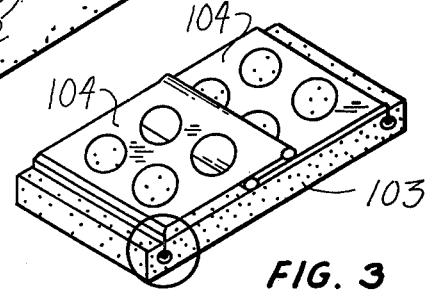
FIG. 3 is a perspective view of a prefabrication of a portion of the first module embodiment.
Figure 4:
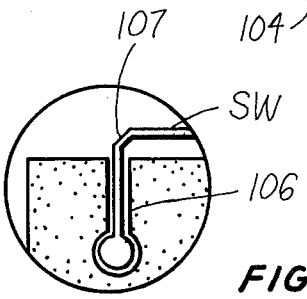
FIG. 4 is a larger-scale fragmentary top plan view of the circled portion of FIG. 3.

In FIG. 1, the modules illustrated are those of the first embodiment, shown in FIGS. 2–4. However, the disclosure and discussion ensuing with relation to FIG. 1 relates, in general, equally to walls constructed using any of the module embodiments, except where noted otherwise. By this device, much repetition of discussion is avoided.

In FIG. 2, the module 10 includes a block body 101 which is shaped much like some conventional hollow rectangular concrete building blocks including two opposed side walls 12, an outer wall 14, an inner wall 16, which are in upstanding perimetrical relation relative to a cavity 18. The outer weatherable surface member 103 is of generally rectangular-solid form. There are two separating webs 104, shown being provided by respective webs, e.g. of flexible synthetic plastic resin with vertical beads 105 at the opposite ends thereof. The block body 101 outer wall 14 is exteriorly provided with two widely spaced vertical grooves or keyways 106, which are enlarged within the block body. Likewise, the rear of theweatherable surface member is exteriorly provided with two comparabley widely spaced vertical grooves or keyways 106. The module 10, as shown in FIG. 2 is constituted by the weatherable surface member 103 ranked exteriorly of the block body, with each separator web 104 fully extended with its one bead 105 received in block body keyway 106 and its other bead 105 received in a weatherable surface member 103. This creats an outer, vertically opening cavity 102. In the instance shown the webs 104 each are provided with one or more openings 22 which open from side-to-side through the width of the respective webs.

Referring back to FIG. 1, a WALL may be built of the modules 10 by ranking and coursing them either with MORTAR or ADHESIVE between adjacent block bodies 101 and between adjacent weatherable surface members 103 in the same row and/or in the vertically adjacent row(s). Bonding as used in conventional walls of similar external appearance may be used, i.e. running bond, flemish bond, etc. Whether or not MORTAR is used between comparable parts of adjacent modules, a PARGE COAT or the like as understood in the building construction trades, may be applied on the outer and/or the inner surfaces of the assembled weatherable surface members and/or of the block bodies. That may be done for the purpose of mechanically bridging the lines of discontinuity at the edges 20, and/or for providing a sufficiently decorative face for the wall.

The vertically interconnected cavities 18 may be filled with a suitable dense, MASSIVE FILLING material such as settable concrete. Likewise, the vertically interconnected cavities 102 are filled with THERMAL INSULATION. The openings 22 permit lateral flow of insulating material as the cavities 102 are being filled. As a non-limiting example the THERMAL INSULATION may be of the sort of foamed synthetic plastic resin that is used as hardened-in-place thermal insulation in the construction trades. Ureaformaldeyde may be used as the resin, as may other compositions.

Thus, there is provided a building wall for which the modules may provide load-bearing structure, an outside finish, thermal insulation, warmth and coolth storage mass, and an inside finish surface. When properly sited and related to the exterior environment (principally the sun's heat and cool night air), the WALL will provide for heating and cooling the building structure in which it is incorporated, and for evening-out swings in air temperature within the building.

Many materials may be used to make the three basic parts of the unfilled module, non-exclusively exemplified by concrete, sulphur concrete, polyester concrete. In general, the basic parts can be extruded or molded using conventional techniques, apparatus and materials.

As the MASSIVE FILLING, there may be used, for example concrete, sand, water, glauber's salt, and/or the same material as is used to make the block body 101 and/or the outer weaatherable surface member 103. It is not essential that the block bodies be hollow as cast or extruded, for receipt of a massive filling, for where desired, the massive filling may be cast-in-place during manufacture of the block body. That is true whether the massive filling consists of more of the same material as the block body is made of, or of some other material.

The SEPARATING WEB may be made of plastic such as polyethylene or polyprophylene, of metal, such as galvanized steel sheet, or of any material capable of holding the two other principal components at their proper interval without conducting any more thermal energy than minimally necessary. Typically, this web would be of molded plastic, be less than one/eighth inch thick, have large holes in it to allow the easy installation of insulation, and have an attachment detail at either end as suggested in detail in FIG. 4. The enlarged end can slide into keyways which are cast into the block body BB and/or weatherable surface member WS during the manufacturing process.

FIGS. 1–4 show a module in which the separation web SW is permanently cast into the weatherable surface slab 103. The block body has keyways 106 cast into it to receive the enlarged ends of the separation web and its joined weatherable surface module. The separation web may be formed of flexible material to allow it to fold as at 107, FIG. 4. The assembly, consisting of the separation webs in folded position, and the weatherable surface member can be shipped in this fashion to the job site, the webs 104 unfolded and inserted into keyways 106 of the block body 101. Masonry mortar, FIG. 1, can be used to bond the edges of weatherable surface WS to the edges of the adjoining WS to provide further strength, stability and seal. Walls built in this fashion can support great loads, having an enduring WS, are well insulated, and provide a very high thermal mass on the interior of the structure. This mass assumes the temperature of the room after a period of time and mitigates against change in temperature of that room due to the energy stored in it. It is in effect, a fly wheel which evens out variations that might otherwise exist in the room.

Less expensive, off-peak energy rates can be taken advantage of by heating the room and its high mass walls during off-peak periods. During peak demand hours the walls give their stored energy back to the room, reducing or eliminating the need for additional fuel.

The same system can be used conversely in the cooling season. The room can be chilled during the night for its effect the following day. If solar energy is admitted into the room through south-facing windows and/or through roof apertures, the great mass of the walls can absorb excess solar energy for later use and prevent the room from being overheated during peak sunlighted periods. This makes is possible to utilize more glass than would otherwise be comfortable, thereby increasing the solar contribution to the heating of the building structure.

Figure 5:
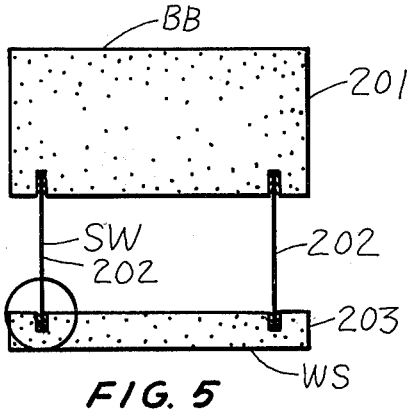
FIG. 5 is a top plan view of a second module embodiment.
Figure 6:
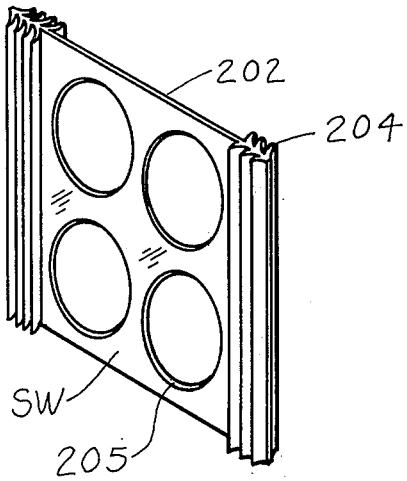
FIG. 6 is an isometric view of one spacer web thereof.
Figure 7:
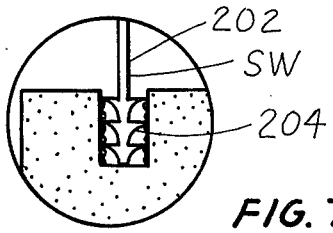
FIG. 7 is a fragmentary, larger-scale top plan view of the circled portion of FIG. 5.

FIGS. 5–7 show that the block body 201 can be manufactured in a solid rather than hollow condition. It also shows a jam-fit locking system on the ends of the separating webs 202. Both the weatherable surface slab 203 and the separating webs 202 have identical grooves to receive the non-rigid fingers 204 of the separating webs 202. The non-rigid fingers 204 are configured to push into a parallel walled groove with relative ease, but not to pull out, because of the tendency of the fingers to spread and accomplish greater grip when outward force is applied to them. The separating webs 203 have openings 205 to allow the thermal insulation to flow freely from module to module during installation. These holes 205 also reduce the amount of thermal conducting material available to conduct energy from the block body to the weatherable surface slab and visa versa. This reduction of a heat transfer route is a principal aim of the invention.

FIG. 8 shows a block body 301 molded with grooves 302 to receive respective separating webs SW that grip the block body 301 and grip the weatherable surface member WS via slots 303 formed in the ends of the weatherable surface member WS. The SW is configured to preclude outward or inward movement of the weatherable surface member relative to the block body.

FIG. 9 shows a configuration that does not require as fragile a block body BB as in FIG. 8. The block body BB of FIG. 9 is gripped on two adjacent sides at corners by each separating web SW and therefore complete penetration of the block body wall by slots is not necessary. The separating web 401 grips one module only. The separating web 402 grips two modules together. The same choice is offered in the embodiments of FIGS. 10 and 11.

The embodiment shown in FIG. 10 utilizes an ordinary concrete block as the block body 501. The weatherable surface member WS is a two inch concrete block modified only by having a slot 503 in either end. The separating webs SW use the one-way, flexible fingers of the FIGS. 5–7 embodiment to accomplish mechanical connection of the separating webs SW to the block body BB and of the separating webs SW to the weatherable surface slab WS. The three elements of this module can be site-assembled prior to installation in a wall. The weatherable surface member WS is then attached to the separating webs SW via the locking fingers of the separating webs.

FIG. 11 shows a module that employes a standard concrete or cinder construction block as its block body 601 and a standard flue block-half as the weatherable surface member WS. Between them there is provided a thermal break block 603 of thermal insulation material such as cellular board. Staples 604, 605 are pressed into holes 606 through the sides of the two constituent blocks BB, WS. The staples are inserted into the holes 606 and their ends are bent over to form mechanical connections not unlike common paperfastening staples, but on a larger scale. FIGS. 12 and 13 show fasteners for single and double building blocks. Thermal break block 603 keeps the heat conducting walls of the masonry units BB, WS from touching each other and the staples 604, 605 keep them from moving apart.

FIG. 14 shows a solid or hollow block body BB with holes 701 in it to receive a separating web SW consisting of rods with one-way jam-fit, flexible fingers as described above. The weatherable surface member WS has similar holes 701. The block bodies BB are laid-up traditionally. Then the separating webs SW are pressed into place and finally the weatherable surface WS is pressed into the separating webs SW. Mortar may be used to bond one module to those surrounding it.

FIG. 15 shows a module which has separating webs SW permanently cast into the block body BB. The weatherable surface member WS has holes 801 through it. The holes are surrounded by and circumferentially encroached-upon by one-way metal grips 802. The metal grips 802 each have a slightly conical configuration which allows a respective rod of the respective separating web to slide through the respective hole 801 in the respective grip 802 in one direction, but not in the other direction. The one-way grippers secure the rods of the separating webs, thereby holding the weatherable surface member WS permanently in place. This module may be shipped with the cast-in-place separating webs 803 folded flat against the outer face of the block body BB. The weatherable surface slab WS is shipped unattached. The block bodies BB are laid-up, then the rods of the separating webs are bent-out perpendicularly to the surface of the block body BB. Now the weatherable surface member WS is pressed onto the ends of the rods. Once again, the weatherable surface member WS may be mortared to the surrounding weatherable surface modules. An alternative to mortar joints between the modules is a trowlled on or sprayed on parge coat of glass fiber-reinforced concrete or the like.

FIGS. 16–18 show another version of the module with two more versions of the separating web SW. The body block BB and the weatherable surface slab WS are grooved appropriately to receive either one separating web SW as shown in FIG. 17 and one as shown in FIG. 18, or two of either type. Both are preferably made of extruded thermoplastic and both have air cavities 901 within them which thermally insulate the block body BB from the weatherable surface member WS. The sole difference between constructions of FIGS. 17 and 18 is the mode of attachment of the web ends to the masonry components.

Figure 19:
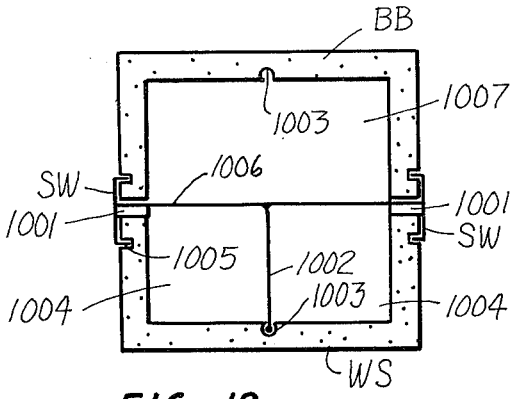
FIG. 19 is a top plan view of a tenth module embodiment.

FIG. 19 shows a module which employs two identical masonry units as the block body BB and the weatherable surface member WS. They are interchangeable. Once again the separating webs SW each have a multiple-air compartment-insulation thermal break area 1001. This thermal break slows energy flow from inside to outside. The masonry units BB and WS are slotted to receive the locking fingers 1005 of the separating webs SW. In this unit the separation webs SW each have a reinforcing element 1002 that locks into a keyway 1003. Cavities 1004 are later filled with concrete or other thermal mass storage medium. The reinforcing element 1002 prevents transverse member 1006 from bulging outward, which would reduce the size of the insulation-receiving cavity 1007. After the concrete or the like is installed, then the insulation can be installed in the cavity 1007.

Figure 20:
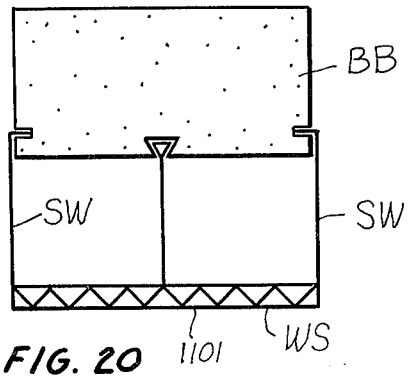
FIG. 20 is a top plan view of an eleventh module embodiment.
Figure 21:
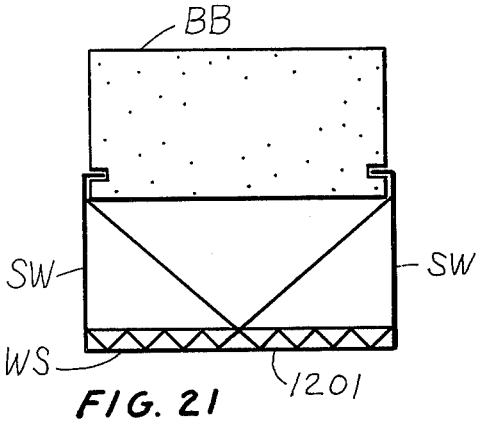
FIG. 21 is a top plan view of a twelfth module embodiment.

FIGS. 20 and 21 show modules in which the separating webs are combined with the weatherable surface member WS. A hollow or solid block body BB is employed, once again with slots or keyways to receive the fingers of the separating webs. The weatherable surface WS is part of the extrusion 1101, 1201 that comprises the separation webs SW and their attachments to the block bodies BB as well as the corrugation-reinforced weatherable surface members. The weatherable surfaces in these two embodiments WS preferably are covered with fiber-reinforced concrete parge or cosmetic treatment that seals the joints. Conversely, mortar or caulk can be used in the joints of the several weatherable surface members.

Figure 22:
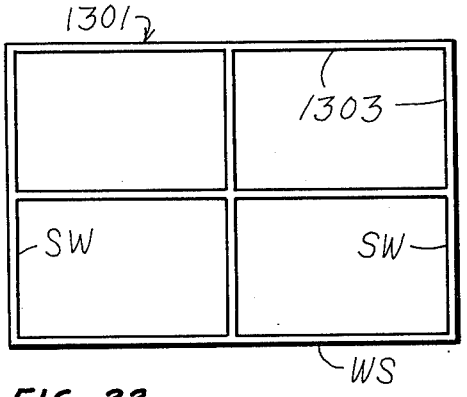
FIG. 22 is a top plan view of a thirteenth module embodiment.

FIG. 22 shows a module constituted by an integral thin wall extrusion that combines a block body 1301 with a weatherable surface member 1302. The separating webs SW are very thin in cross section, rather than being thermally non-conductive. The thinness of the separating webs SW effectively limits heat transfer from inside to outside. The thinness of the walls 1303 requires use of a high-strength concrete such as polyester concrete, or the entire module can be extruded of plastic or pultruded of fiber-reinforced plastic.

Figure 23:
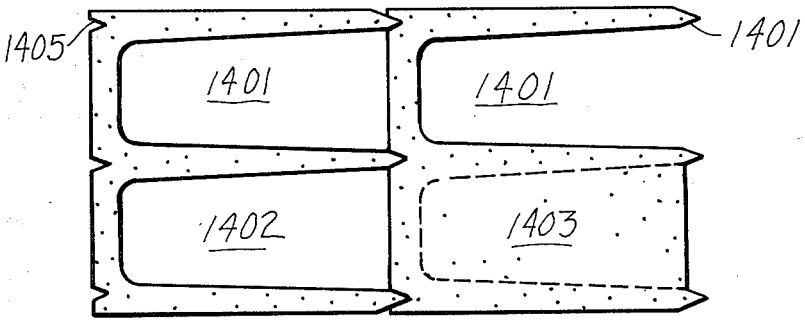
FIG. 23 is a top plan view of a wall incorporating two varied examples of a fourteenth module embodiment.

FIG. 23 shows two unique modules, each cast in one piece. The two units are shown side by side. The one on the left has one hollow 1401 for insulation and one hollow 1402 for concrete or the like. The module on the right has the concrete portion 1403 pre-cast solid; its insulation cavity 1401 is identical to the one of the module on the left. Male locking fingers 1404 engage female grooves 1405 in the adjacent module. This is for the purpose of easy alignment of the blocks during construction of a wall. The modules are arranged with their cavities aligning vertically to allow easy filling of the hollows from above. These units have no thermal break per se between inner and outer surfaces, but the E-shaped interlocking nature eliminates one of the separation webs at one side and thereby reduces heat loss due to conduction. A wall can be built from these modules alternating in kind, or all as at the left or all as at the right.

Figure 24:
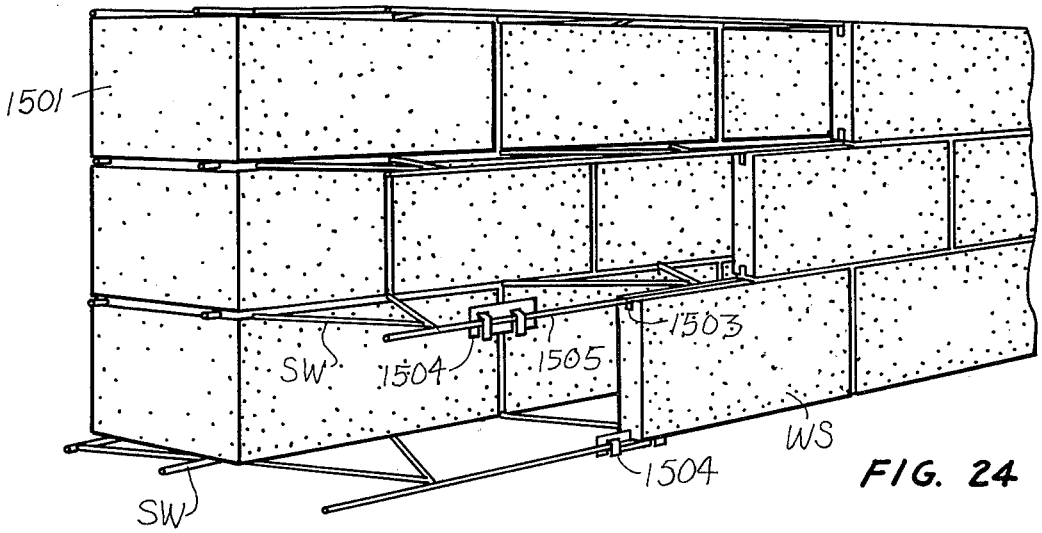
FIG. 24 is a perspective view of a partially constructed wall incorporating examples of a fifteenth module embodiment.

FIG. 24 shows a wall laid-up of standard hollow or solid blocks 1501. The mortar joints between courses have wire reinforcements that act as the separating webs SW. The weatherable surface units WS are grooved at 1503 top and bottom to receive spring attachment clips 1504. The weatherable surface units are preferably made of concrete and are laid-up either dry or with mortar. The spring atachment clips 1504 snap onto the outermost wires 1505 of the separating webs SW. The weatherable surface units WS are placed down over the protruding top edges of the spring clips of the course just below. Further spring clips 1504 are snapped down into place at the top of the respective weatherable surface unit WS being installed. Each weatherable surface unit WS is therefore pinned in place bottom and top. If the joints are not mortared, the fiber reinforced concrete parge is required as a surface coat. The insulation cavity between each block body BB and respective weatherable surface unit WS is then filled with insulation material.

It should now be apparent that the high mass wall module for environmentally driven heating and cooling system as described hereinabove, psssesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A high mass module for an environmentally driven heating and cooling system, said module comprising:

a block body for incorporating massive material;

an outer wear surface member ranked outside the block body, with a space thus defined therebetween;

separator web means extending between and joining the block body to the outer wear surface member;

the block body is generally tubular, having a lumen for receipt of a massive filling;

the separator web means comprising two laterally spaced webs of thin, flexible sheet material; and two respective securement means for securing both the webs to the block body and to the weatherable surface member;

said block body including a generally vertical slot connecting the exterior of the outer side of the block body with the lumen thereof, and at one end thereof one of said webs has the respective securement means stuck through said slot and bearing against the block body both internally of the lumen and externally of the slot to lock that end of that web to the block body;

a second generally tubular block body coursed along with the first-mentioned block body and having a lumen for receipt of a massive filling;

the second block body including a generally vertical slot connecting the exterior of the outer side of the second block body with the lumen thereof;

the last-mentioned web further including a branch web, based thereon at the opposite end of that web, and having a free end provided with a third securement means;

the third securement means being stuck through the slot of said second block body and bearing against the second block body both internally of the lumen of the second block body and externally of the slot of the second block body to lock the free end that web branch to the second block body.

2. A high mass module for an environmentally driven heating and cooling system, said module comprising:

a block body for incorporating massive material;

an outer wear surface member ranked outside the block body, with a space thus defined therebetween;

separator web means extending between and joining the block body to the outer wear surface member;

at least one of said block body and said weatherable surface member being a generally rectangular-sided three-dimensional object having a plurality of edges where respective two adjacent sides meet;

the separator web means comprising two laterally spaced webs of thin, flexible sheet material; and two respective securement means for securing both the webs to the block body and to the weatherable surface member;

the three-dimensional object including means defining two generally vertical grooves therein ramked on opposite sides of one of said edges, adjacent that one edge; and at one end thereof, one of said webs having the respective securement means constituted by a pair of generally right angle-opposed fingers respectively inserted into said two generally vertical grooves to lock that end of that web to the three-dimensional object.

3. The high mass module of claim 2, further including:

a second generally rectangular-sided three-dimensional object coursed along with the first-mentioned three-dimensional object and being of the same selection as said first-mentioned three-dimensional object from the group consisting of block body and weatherable surface member;

the second generally rectangular-sided three-dimensional object having a plurality of edges where respective two adjacent sides meet;

the second generally rectangular-sided three-dimensional object having means defining two generally vertical grooves therein ranked on opposite sides of one of said edges of said second generally rectangular-sided three-dimensional object; and at said one end thereof, said one web having a second respective securement means thereon, constituted by a pair of generally right angle-opposed fingers respectively inserted into the last-mentioned two generally vertical grooves to also lock that end of that web to the second generally rectangular-sided three-dimensional object.

4. A high mass module for an environmentally driven heating and cooling system, said module comprising:

a block body for incorporating massive material;

an outer wear surface member rankjed outside the block body, with a space thus defined therebetween;

separator web means extending between and joining the block body to the outer wear surface member;

said block body being a multiluminal concrete building block having opposed integral tabs at each end of inner and outer faces thereof;

the separator web means comprising two laterally spaced webs of thin, flexible sheet material; and two respective securement means for securing both the webs to the block body and to the weatherable surface member; and at one end thereof, one of said webs having the respective securement means constituted by a pair of generally parallel, laterally codirected, barbed-ended fingers, these fingers intercalating one of said tabs between them, with the respective barbed ends in securing engagement with that tab.

5. The high mass module of claim 4, further including:

a second block body in the form of a multicavity concrete building block having opposed integral tabs at each end of the inner and outer faces thereof;

the first-mentioned and second concrete blocks being coursed together so that two tabs at one end of the first-mentioned concrete block lie adjacent two tabs of the second concrete block;

at said one end thereof, said one web having the respective securement means further constituted by a second pair of generally parallel, laterally codirected, barbed-ended fingers which extend laterally oppositely from the first-described pair of barbed-ended fingers;

the fingers of this second pair intercalating the adjacent tab of the second concrete block between them, with the respective barbed ends thereof in securing engagement with that tab.

* * * * *